US006281128B1

(12) United States Patent
Maury et al.

(10) Patent No.: US 6,281,128 B1
(45) Date of Patent: Aug. 28, 2001

(54) WAFER CARRIER MODIFICATION FOR REDUCED EXTRACTION FORCE

(75) Inventors: Alvaro Maury; John A. Maze; Frank Miceli; Jose Omar Rodriguez; Robert M. Symons, all of Orlando, FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/332,216

(22) Filed: Jun. 14, 1999

(51) Int. Cl.[7] ..... H01L 21/302; H01L 21/461

(52) U.S. Cl. ..... 438/691; 438/692

(58) Field of Search ..... 438/691, 692, 438/693; 216/88, 89; 451/41, 289, 5, 288, 398, 285, 388, 387, 259, 260, 278

(56) References Cited

U.S. PATENT DOCUMENTS 5,695,392 * 12/1997 Kim ..... 451/288
5,788,560 * 8/2000 Hashimoto et al. ..... 451/288
5,814,240 * 9/1998 Yamashita ..... 438/692
6,080,049 * 6/2000 Numoto et al. ..... 451/285
6,089,961 * 7/2000 Cesna et al. ..... 451/285
6,102,779 * 8/2000 Cesna et al. ..... 451/41

* cited by examiner

*Primary Examiner*—Robert Kunemund
*Assistant Examiner*—Duy-Vu Deo

(57) ABSTRACT

The present invention provides a wafer carrier for use with a semiconductor wafer polishing apparatus. In one embodiment, the wafer carrier comprises a carrying head having opposing first and second surfaces, a primary channel system formed in the second surface, and a secondary channel system formed in the second surface. The first surface is coupleable to the semiconductor polishing apparatus and the second surface is adapted to receive a semiconductor wafer to be polished. The primary channel system comprises first and second intersecting channels. The secondary channel system intersects the primary channel system so that the secondary channel system and the primary channel system cooperate to occupy a substantial portion of a surface area of the second surface. Therefore, the primary channel system and the secondary channel system decrease an amount of force required to remove the semiconductor wafer from the second surface.

6 Claims, 3 Drawing Sheets

WAFER CARRIER MODIFICATION FOR REDUCED EXTRACTION FORCE

TECHNICAL FIELD OF THE INVENTION

The present invention is directed, in general, to a semiconductor wafer polishing apparatus and, more specifically, to a semiconductor wafer carrier having an intersecting relieved surface to reduce the probability of wafer breakage during unloading.

BACKGROUND OF THE INVENTION

In the fabrication of semiconductor components, various devices are formed in layers upon an underlying substrate that is typically composed of a semiconductor material, such as silicon. The various discrete devices are interconnected by metal conductor lines to form the desired integrated circuits. The metal conductor lines are further insulated from the next interconnection level by thin films of insulating material deposited by, for example, CVD (Chemical Vapor Deposition) of oxide or application of SOG (Spin On Glass) layers followed by fellow processes. Holes, or vias, formed through the insulating layers provide electrical connectivity between successive conductive interconnection layers. In such microcircuit wiring processes, it is desirable that the insulating layers have a smooth surface topography, since it is difficult to lithographically image and pattern layers applied to rough surfaces.

Conventional chemical/mechanical polishing (CMP) has been developed for providing smooth semiconductor topographies. Chemical/mechanical polishing (CMP) can be used for planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers. Semiconductor wafers may also be planarized to: control layer thickness, sharpen the edge of via "plugs", remove a hardmask, remove other material layers, etc. Significantly, a given semiconductor wafer may be planarized several times, such as upon completion of each metal layer. For example, following via formation in a dielectric material layer, a metalization layer is blanket deposited and then CMP is used to produce planar metal studs.

Briefly, the CMP process involves holding and rotating a thin, reasonably flat, semiconductor wafer against a rotating polishing surface. The polishing surface is wetted by a chemical slurry, under controlled chemical, pressure, and temperature conditions. The chemical slurry contains a polishing agent, such as alumina or silica, which is used as the abrasive material. Additionally, the slurry contains selected chemicals which etch or oxidize selected surfaces of the wafer during processing. The combination of mechanical and chemical removal of material during polishing results in superior planarization of the polished surface. In this process it is important to remove a sufficient amount of material to provide a smooth surface, without removing an excessive amount of underlying materials. Accurate material removal is particularly important in today's submicron technologies where the layers between device and metal levels are constantly getting thinner.

One problem area associated with chemical/mechanical polishing is in the step of removing the planarized wafer from the wafer carrier in which it is held for polishing without damaging the wafer. The wafers are temporarily stored in deionized (DI) water while awaiting CMP or further processing. With the inner face of the wafer carrier wetted by DI water and the semiconductor wafer in contact with the inner face, the DI water creates a capillary adhesion force between the semiconductor wafer and the wafer carrier. As the CMP process proceeds, all gases, e.g., air, are expelled from between the wafer and the wafer carrier inner face. The resultant effect is the formation by adsorption of a thin film between the surface of the wafer carrier and the surface of the wafer. The DI water film adheres to the surfaces of both the semiconductor wafer and the wafer carrier. Thus, when the CMP process is complete and the wafer is to be returned to a storage location, the semiconductor wafer clings to the wafer carrier. It is necessary to break the seal between the wafer and the wafer carrier without damaging the wafer. Conventional eight inch wafer carriers, such as those associated with a SpeedFam polisher tool #9206) have two fluid draining grooves of approximately 0.25" width in a cruciform pattern about the center of the cup. Thus, the relieved area in which adhesion cannot occur is about eight percent (~4 $in^2$/~50 $in^2$=0.08) of the total cup surface area. Experience has shown that this configuration requires excessive force to "break" the adhesion between the wafer and the wafer carrier, resulting in wafer breakage. This is, of course, highly undesirable because of the cost associated with the lost production cost associated with such breakage.

Accordingly, what is needed in the art is an improved wafer carrier design that minimizes semiconductor wafer breakage while reducing unload cycle time.

SUMMARY OF THE INVENTION

To address the above-discussed deficiencies of the prior art, the present invention provides a wafer carrier for use with a semiconductor wafer polishing apparatus. In one embodiment, the wafer carrier comprises a carrying head having opposing first and second surfaces, a primary channel system formed in the second surface, and a secondary channel system formed in the second surface. The first surface is coupleable to the semiconductor polishing apparatus and the second surface is adapted to receive a semiconductor wafer to be polished. The primary channel system comprises first and second intersecting channels. The secondary channel system intersects the primary channel system so that the secondary channel system and the primary channel system cooperate to occupy a substantial portion of a surface area of the second surface. Therefore, the primary channel system and the secondary channel system decrease an amount of force required to remove the semiconductor wafer from the second surface.

In an alternative embodiment, the primary channel system is a cruciform channel system and the first and second intersecting channels each have a width of about 12 percent of a diameter of the second surface. In another embodiment, the wafer carrier further comprises a third channel system that intersects the primary and secondary channel systems.

The secondary channel system may be an annular channel, and in one particular aspect, an inner radius of the annular channel is about 12 percent of a diameter of the second surface and an outer radius is about 45 percent of the diameter.

In yet another embodiment, the substantial portion is greater than about 50 percent of the surface area, which provides a greater channeling area for the fluid and, thereby, reduces the amount of force required to break the seal between the carrier surface and the wafer, which is formed by the fluid. Alternatively, the substantial portion may be about 85 percent of the surface area. The primary channel system and the secondary channel system, in another embodiment, may be about 0.251" deep.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
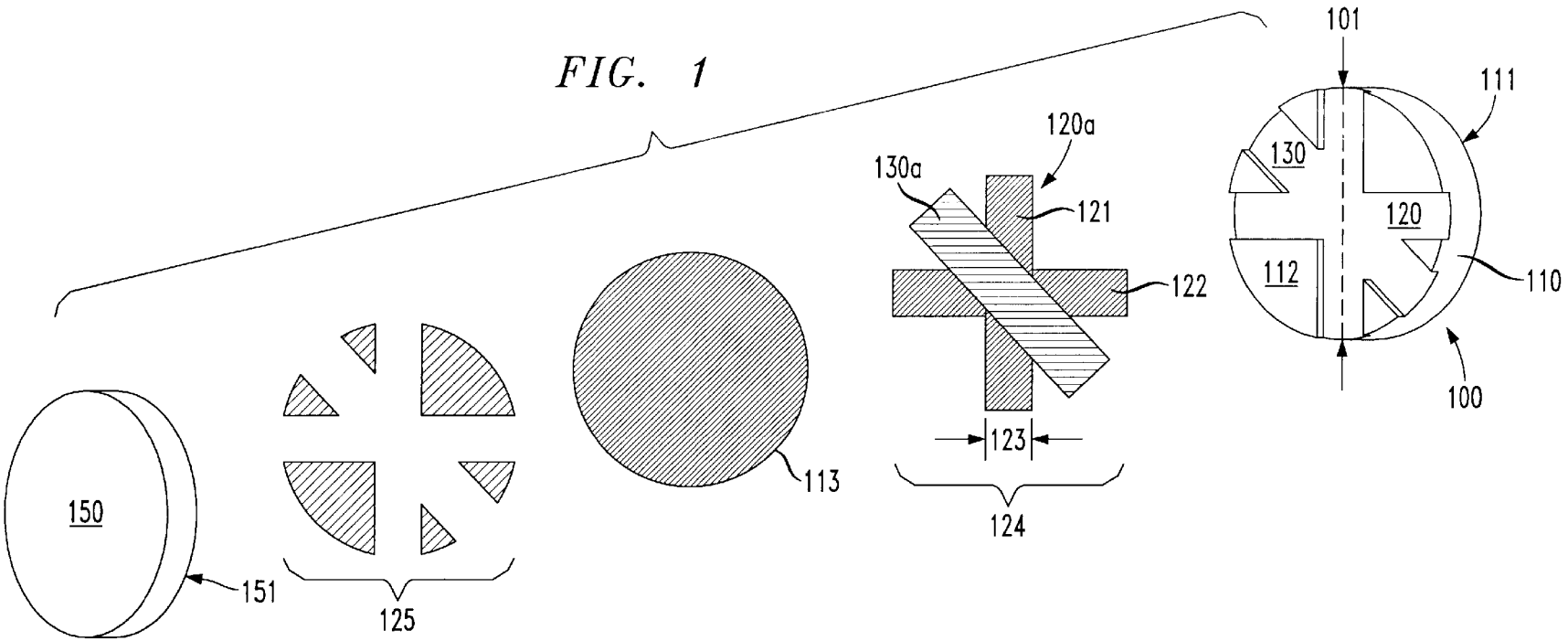
FIG. 1 illustrates an exploded isometric view of one embodiment of a wafer carrier constructed according to the principles of the present invention with a semiconductor wafer.

Referring initially to FIG. 1, illustrated is an exploded isometric view of one embodiment of a wafer carrier constructed according to the principles of the present invention with a semiconductor wafer. A wafer carrier 100 comprises a carrier head 110 having opposing first and second surfaces 111, 112. The first surface 111 is adapted to couple to a chemical/mechanical polishing (CMP) apparatus (not shown). The second surface 112 is configured to receive a semiconductor wafer 150 for polishing. One who is skilled in the art is familiar with the coupling mechanism for securing a wafer carrier to a CMP apparatus and the method of installing a semiconductor wafer in a wafer carrier.

Formed in the second surface 112 is a primary channel system 120 comprising first and second intersecting channels 121, 122. In a specific embodiment, the primary channel system is cruciform in shape 120*a*. A width 123 of the first and second intersecting channels 121, 122 is typically about 12 percent of a diameter 101 of the second surface 112. However, the channel width 123 may be varied to achieve a desired combined area. Intersecting the primary channel system 120 is a secondary channel system 130. In the illustrated embodiment, the secondary channel system 130, is about the same width as the primary channel members 121, 122 and intersects the primary channel system 120. The primary and secondary channel systems 120, 130 are preferably formed by removing material to a depth of about 0.1251" from the second surface 112.

A combined area 124 of the primary and secondary channel systems 120, 130 constitute a substantial portion, e.g., greater than about 50 percent, of a projected total surface area 113 of the second surface 112. The cooperation of the primary and secondary channel systems 120, 130 provides a path for fluid to flow from between a mounting face 151 of the semiconductor wafer 150 and the second surface 112. This, in turn, reduces a contact surface area 125 of the second surface 112 that contacts the semiconductor wafer mounting face 151.

One who is skilled in the art is familiar with the process of planarizing a semiconductor wafer 150, and the fact that a fluid, usually water, becomes interposed between the wafer 150 and the inner face of the wafer carrier 100. Capillary fluid forces act upon the wafer 150 and wafer carrier 100 surfaces thereby impeding removal of the wafer 150 after CMP. By providing primary and secondary intersecting channel systems 120, 130, fluid may flow away from the contact surface area 125, thereby reducing the capillary forces holding the semiconductor wafer 150 to the carrier head 110. Thus, the capillary fluid forces are reduced to an acceptable level that minimizes the likelihood of wafer breakage upon wafer 150 removal. In one embodiment, the combined area 124 of the primary and secondary channel systems 120, 130 may be in excess of 50 percent of the projected surface area 113.

Figure 2:
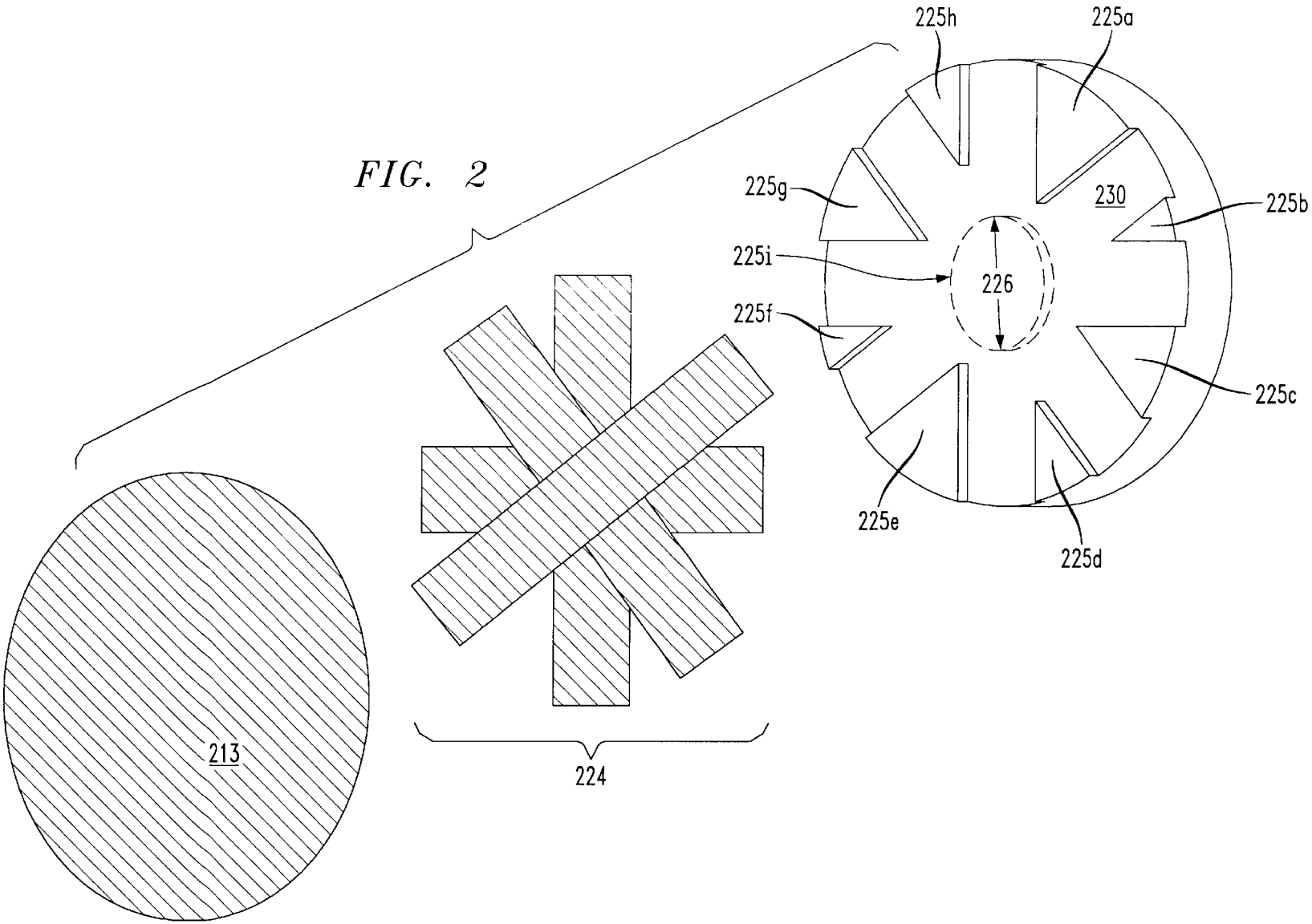
FIG. 2 illustrates an isometric view of an alternative embodiment of the wafer carrier of FIG. 1.

Referring now to FIG. 2, illustrated is an isometric view of an alternative embodiment of the wafer carrier of FIG. 1. In this embodiment, a secondary channel system 230 is also cruciform in shape, thereby further increasing a combined area 224 when compared to a projected total surface area 213, and reducing capillary adhesion forces. Therefore, areas 225*a*–225*h* comprise the surface area in contact with a semiconductor wafer. Optionally, a central circular region 225*i* may also be retained at a level equal to regions 225*a*–225*h*. A diameter 226 of central circular region 225*i* may be varied to control the total surface contact area, i.e., areas 225*a*–225*h* plus central circular region 225*i*.

Figure 3:
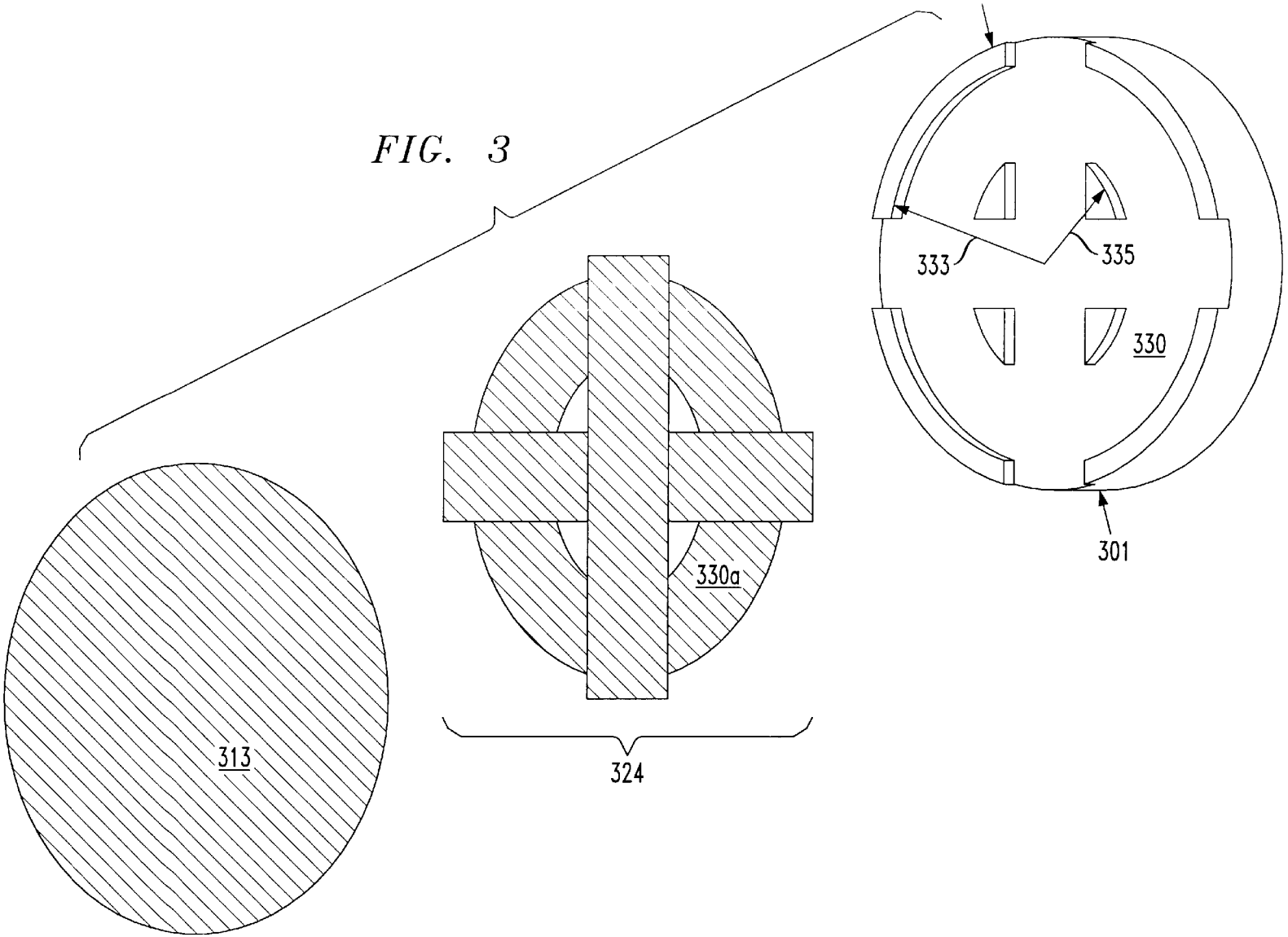
FIG. 3 illustrates an isometric view of another alternative embodiment of the wafer carrier of FIG. 1.

Referring now to FIG. 3, illustrated is an isometric view of another alternative embodiment of the wafer carrier of FIG. 1. In this embodiment, a wafer carrier 300 further comprises a secondary channel system 330 that may have arcuate portions 330*a*, thereby forming a combined area 324 that is approximately equal to 85 percent of projected total surface area 313. While it has been found that a reduction of contact surface area by 85 percent is very effective in reducing capillary adhesion forces, it is readily apparent from the present invention that varying degrees or percentages of surface reduction may be achieved. In one embodiment, an outer radius 333 of the annular channel system 330 is about 45 percent of a diameter 301 of the wafer carrier 300 and an inner radius 335 is about 12 percent of the diameter 301. Of course, one may further combine the dual cruciform channel systems 120, 230, of FIGS. 1 and 2, respectively, with a third channel system 330 of FIG. 3 to further control the surface area upon which the semiconductor wafer 150 contacts the carrying head. One who is skilled in the art will readily understand that the designation of first, second, and third channel systems is purely arbitrary.

Thus, a wafer carrier modification has been described that provides cooperating primary and secondary channel systems to reduce the contact area between the wafer carrier and a semiconductor wafer. By reducing the contact area, capillary adhesion forces between the wafer and the wafer carrier head may be substantially reduced and controlled so that wafer breakage during removal is minimized.

Although the present invention has been described in detail, those skilled in the art should understand that they can make various changes, substitutions and alterations herein without departing from the spirit and scope of the invention in its broadest form.

What is claimed is:

1. A method of polishing a semiconductor wafer, comprising:

mounting the semiconductor wafer in a wafer carrier and interposing a fluid between a surface of the wafer carrier and a surface of the semiconductor wafer;

channeling a first portion of the fluid through first and second intersecting channels of a primary channel system formed in the surface of the wafer carrier wherein the first and second intersecting channels each have a width of about 12 percent of the diameter of the wafer carrier;

channeling a second portion of the fluid through a secondary channel system intersecting the primary channel system and formed in the surface of the wafer carrier;

polishing the semiconductor wafer on the polishing apparatus; and removing the semiconductor wafer from the wafer carrier, the primary channel system and the secondary channel system cooperating to occupy a substantial portion of the surface area and thereby decrease an amount of force required to remove the semiconductor wafer from the surface.

2. The method as recited in claim 1 wherein channeling the second portion includes channeling the second portion through a secondary channel system further comprising a third channel system that intersects the primary and secondary channel systems.

3. The method as recited in claim 1 wherein channeling the second portion includes channeling the second portion through a secondary channel system that is an annular channel.

4. The method as recited in claim 3 wherein channeling the second portion includes channeling the second portion through the annular channel that is about 12 percent of the diameter of the wafer carrier and an outer radius is about 45 percent of the diameter.

5. The method as recited in claim 1 wherein mounting further comprises mounting the semiconductor wafer wherein the substantial portion is about 85 percent of the surface area.

6. The method as recited in claim 1 wherein channeling the first portion and channeling the second portion includes channeling the first portion and the second portion through a primary channel system and a secondary channel system that are about 0.125" deep.

* * * * *